US010314396B2

(12) United States Patent
Hsu et al.

(10) Patent No.: US 10,314,396 B2
(45) Date of Patent: Jun. 11, 2019

(54) QUICK DETACHABLE SLIDE RAIL AND DRAWER MOUNTING STRUCTURE

(71) Applicant: Nan Juen International Co., Ltd., New Taipei (TW)

(72) Inventors: Cheng-Liang Hsu, New Taipei (TW); Wei-Liang Liao, New Taipei (TW)

(73) Assignee: NAN JUEN INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 15/717,815

(22) Filed: Sep. 27, 2017

(65) Prior Publication Data

US 2019/0090633 A1 Mar. 28, 2019

(51) Int. Cl.

| | |
|---|---|
| ***A47B 88/40*** | (2017.01) |
| ***A47B 88/49*** | (2017.01) |
| ***A47B 88/42*** | (2017.01) |
| ***A47B 88/47*** | (2017.01) |
| ***A47B 88/407*** | (2017.01) |
| ***A47B 88/497*** | (2017.01) |
| ***A47B 88/423*** | (2017.01) |
| ***A47B 88/477*** | (2017.01) |

(52) U.S. Cl.

CPC ..... *A47B 88/407* (2017.01); *A47B 88/423* (2017.01); *A47B 88/477* (2017.01); *A47B 88/497* (2017.01); *A47B 2088/4235* (2017.01)

(58) Field of Classification Search

CPC . A47B 88/407; A47B 88/0407; A47B 88/423; A47B 88/0418; A47B 88/427; A47B 88/0422; A47B 2088/4235; A47B 2088/0444; A47B 2088/4272; A47B 2088/0425; A47B 2088/4274; A47B 2088/0429; A47B 2088/4276; A47B 2088/0433; A47B 2088/4278; A47B 2088/0437; A47B 2210/09; A47B 2210/091

See application file for complete search history.

(56) References Cited

U.S. PATENT DOCUMENTS

| | | | | |
|---|---|---|---|---|
| 7,549,712 | B2 * | 6/2009 | Booker | F16F 9/0218 312/333 |
| 8,979,223 | B2 * | 3/2015 | Huang | A47B 88/0422 312/334.4 |
| 9,060,604 | B2 * | 6/2015 | Salice | A47B 88/04 |
| 2016/0242543 | A1 * | 8/2016 | Mohr | F16C 29/004 |
| 2017/0135476 | A1 * | 5/2017 | Chen | A47B 88/407 |

FOREIGN PATENT DOCUMENTS

CN 202681151 U * 1/2013

* cited by examiner

*Primary Examiner* — Andrew M Roersma

(57) ABSTRACT

A quick detachable slide rail and drawer mounting structure includes a slide rail assembly, a drawer supported on the slide rail assembly, a connection member mounted at a distal end of an outer slide rail of the slide rail assembly, and a mating connection device set. After connection between the drawer and the outer slide rail of the slide rail assembly, a first toothed rack of the connection member is forced into engagement with a second toothed rack of the mating connection device set with an abutment member of the mating connection device set disposed at the bottom side of the connection member.

8 Claims, 10 Drawing Sheets

QUICK DETACHABLE SLIDE RAIL AND DRAWER MOUNTING STRUCTURE

BACKGROUND OF THE INVENTION

1. Field of the Invention

The present invention relates to sliding rail technology and more particularly to a quick detachable slide rail and drawer mounting structure for quick connection between a slide rail assembly and a drawer in a detachable manner, prohibiting relative displacement between the drawer and the slide rail assembly.

2. Description of the Related Art

For connection between a drawer and a slide rail assembly in a cabinet, a connection structure is necessary. When connected, the drawer can be moved with the slide rail assembly in and out of the cabinet. This connection structure has a connection member fastened to a distal end of the slide rail assembly, and a mating connection device affixed to the bottom panel of the drawer and fastened to the connection member. The installation of this prior art connection structure is complicated and not detachable, complicating the installation.

SUMMARY OF THE INVENTION

The present invention has been accomplished under the circumstances in view. It is therefore the main object of the present invention to provide a quick detachable slide rail and drawer mounting structure, which uses a connection member and a mating connection device set for connection to the slide rail assembly and the drawer respectively, allowing the drawer and the slide rail assembly to be conveniently and detachably fastened together without any tools.

To achieve this and other objects of the present invention, a quick detachable slide rail and drawer mounting structure comprises a slide rail assembly, a drawer, a connection member and a mating connection device set. The slide rail assembly comprises an inner slide rail and outer slide rail. The outer slide rail is attached onto the inner slide rail and slidable relative to the inner slide rail. The drawer is fastened to the outer slide rail of the slide rail assembly. The connection member comprises a base, and a first toothed rack disposed at one lateral side of the base. The base is affixed to a distal end of the outer slide rail of the slide rail assembly to hold the first toothed rack at one lateral side of the outer slide rail. The mating connection device set comprises a holder block and an abutment member. The holder block comprises a bottom panel, and a second toothed rack disposed at one side of the bottom panel. The abutment member is mounted at a bottom side of the bottom panel and movable in and out of the bottom panel. The holder block is mounted at a bottom wall of the drawer.

Thus, when the drawer and the outer slide rail of the slide rail assembly are connected together, the first toothed rack of the connection member is engaged with the second toothed rack of the mating connection device set to prohibit the drawer from longitudinal and sideway displacement, and the abutment member of the mating connection device set is exposed to the outside of the bottom panel and disposed at a bottom side of the base of the connection member to prohibit relative vertical displacement between the drawer and the outer slide rail.

DETAILED DESCRIPTION OF THE PREFERRED EMBODIMENT

Figure 1:
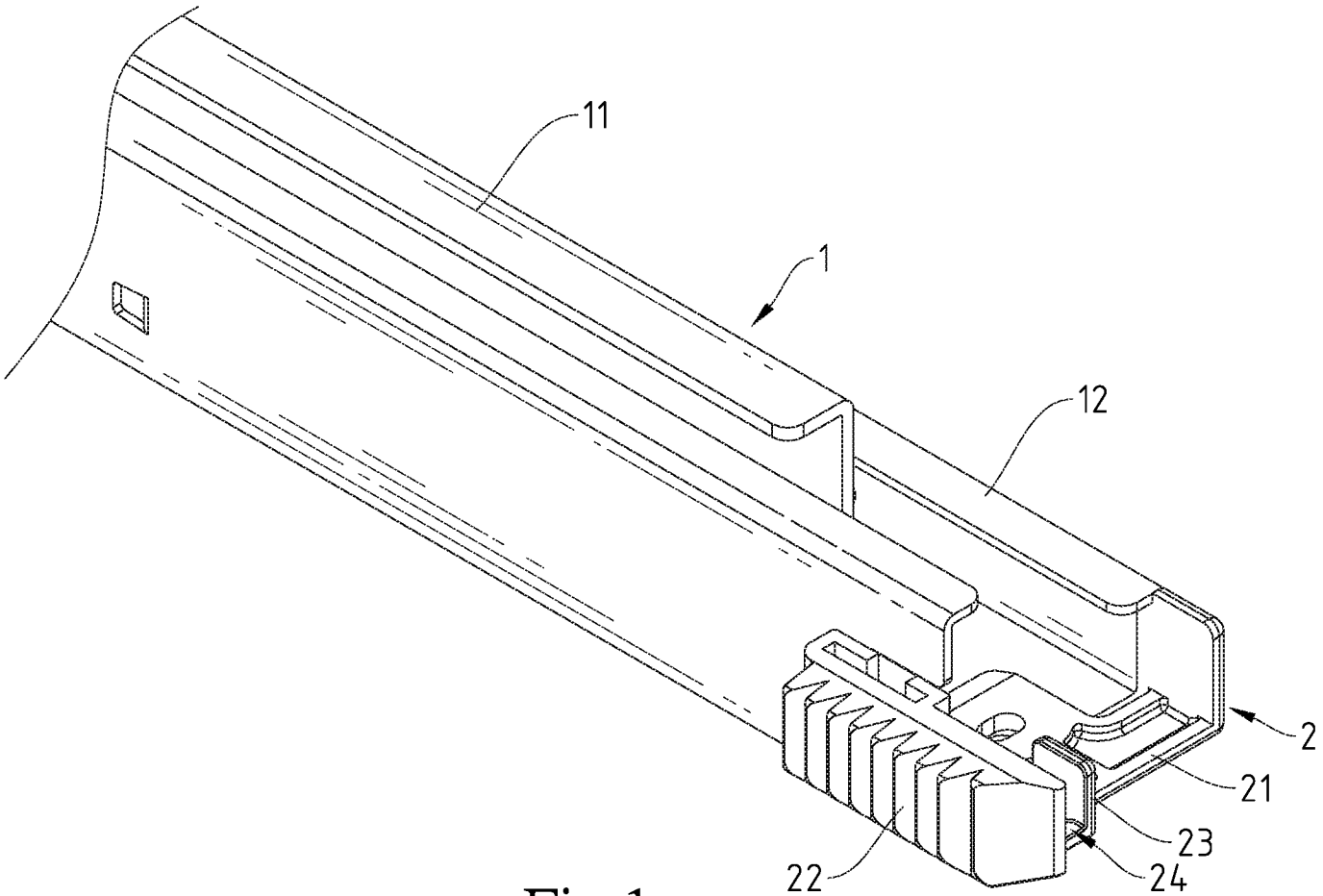
FIG. 1 is an oblique elevational view illustrating a connection member of a quick detachable slide rail and drawer mounting structure mounted at a slide rail assembly in accordance with the present invention.

Referring to FIGS. 1-8, a quick detachable slide rail and drawer mounting structure in accordance with the present invention is shown. The quick detachable slide rail and drawer mounting structure comprises a slide rail assembly 1, a connection member 2, a mating connection device set 3 and a drawer 4.

The slide rail assembly 1 comprises an inner slide rail 11 and an outer slide rail 12. The outer slide rail 12 is attached onto the inner slide rail 11 and slidable relative to the inner slide rail 11.

The connection member 2 comprises a base 21, a first toothed rack 22 disposed at one lateral side relative to the base 21, a stop block 23 extended from the base 21, and an insertion groove 24 defined between the stop block 23 and the first toothed rack 22. The base 21 is affixed to a free end of the outer slide rail 12 of the slide rail assembly 1 to hold the first toothed rack 22 at one lateral side of the outer slide rail 12.

The mating connection device set 3 comprises a holder block 31, an abutment member 32, a spring member 33, a push member 34, a shock damper 35, an adjustment screw bolt 36 and a top cover 37.

Figure 2:
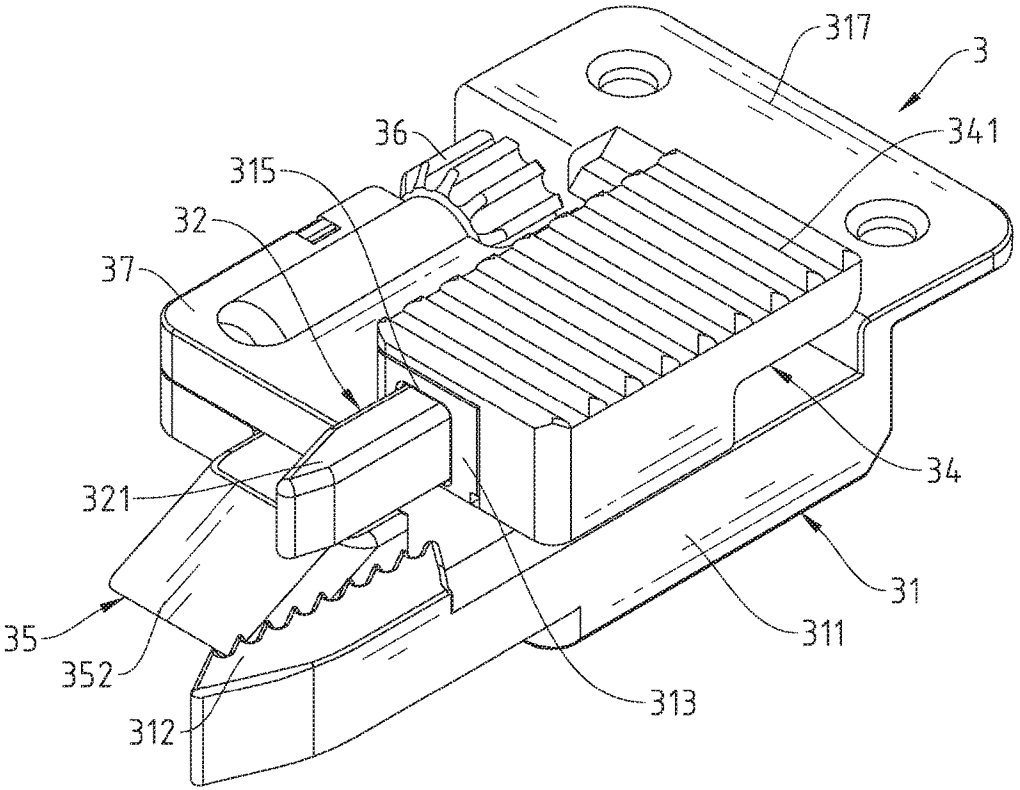
FIG. 2 is an oblique elevational view of the mating connection device set of the quick detachable slide rail and drawer mounting structure in accordance with the present invention.
Figure 4:
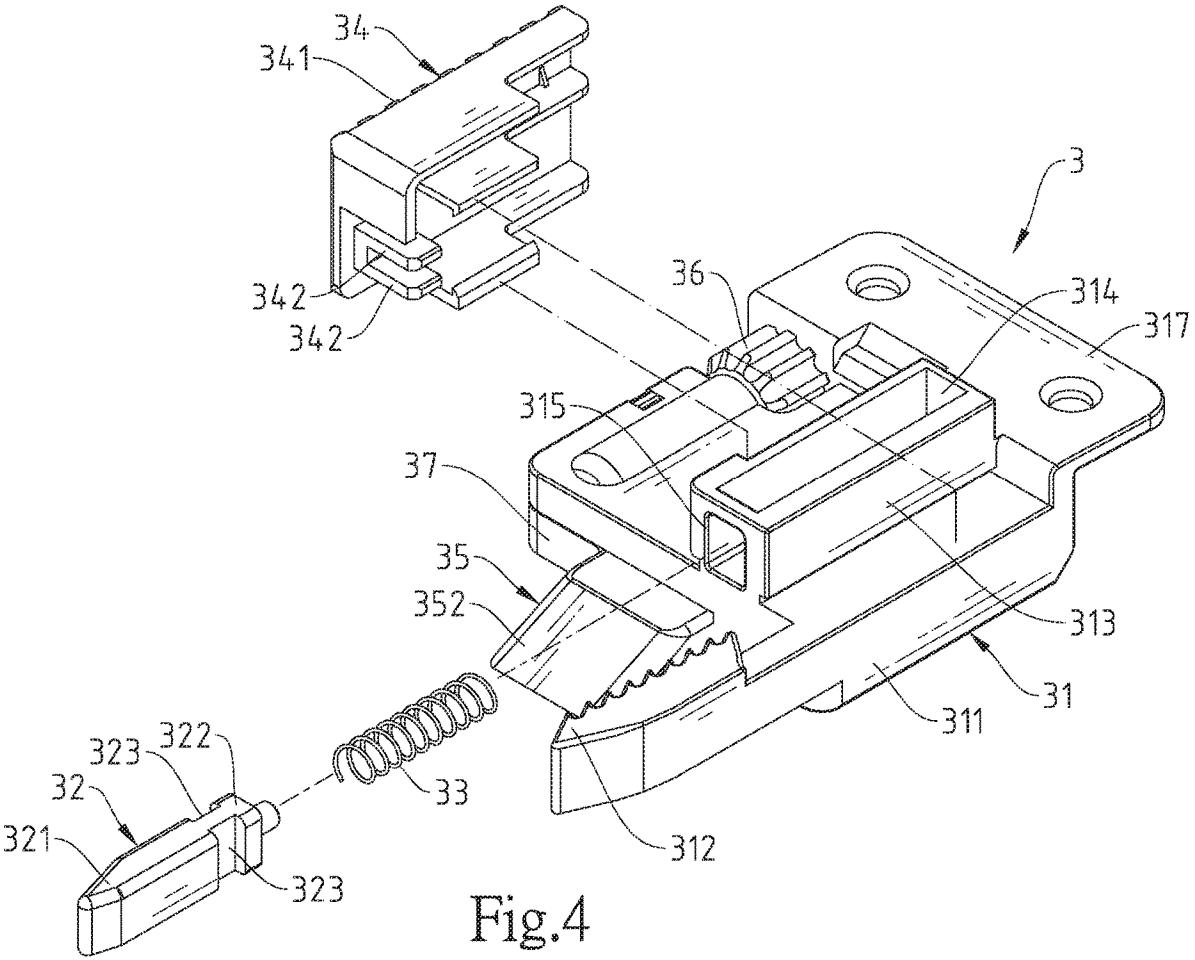
FIG. 4 is an exploded view of the mating connection device set of the quick detachable slide rail and drawer mounting structure in accordance with the present invention.
Figure 6:
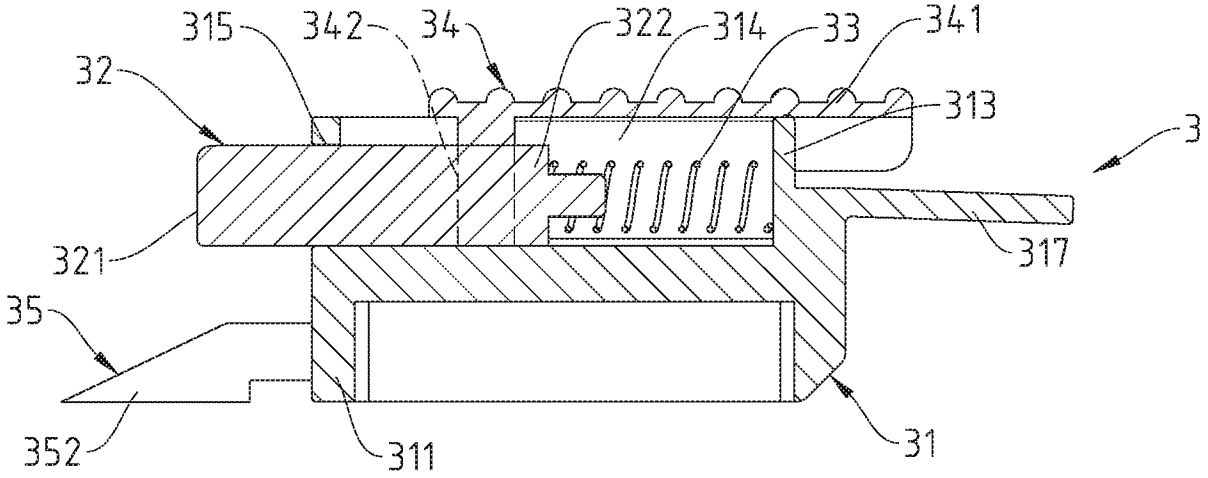
FIG. 6 is a schematic sectional view of the mating connection device set of the quick detachable slide rail and drawer mounting structure in accordance with the present invention.

As illustrated in FIGS. 2, 4 and 6, the holder block 31 of the mating connection device set 3 comprises a bottom panel 311, a mounting plate 317 extended from one end of the bottom panel 311, a second toothed rack 312 extended from one lateral side of the bottom panel 311 remote from the mounting plate 317, a receptacle 313 located a bottom side of the bottom panel 311 and defining therein an accommodation chamber 314 and a front opening 315 in communication between the accommodation chamber 314 and the outside of the receptacle 313. The abutment member 32 has two opposite ends thereof respectively terminating in an abutment end portion 321 and a mounting end portion 322 with two opposing locating grooves 323. The abutment member 32 is mounted in the accommodation chamber 314 with the abutment end portion 321 extended out of the front opening 315 of the receptacle 313. The spring member 33 is stopped between the mounting end portion 322 of the abutment member 32 and an inside wall of the accommodation chamber 314. The push member 34 attached to the outer surface of the receptacle 313, comprising a pushing portion 341 and a retaining portion 342 located at a bottom side of the pushing portion 341 and engaged with the locating grooves 323 of the abutment member 32 in the accommodation chamber 314. Thus, the push member 34 can move the abutment member 32 toward the inside of the accommodation chamber 314 to compress the spring member 33 for storing elastic restoring energy.

Figure 3:
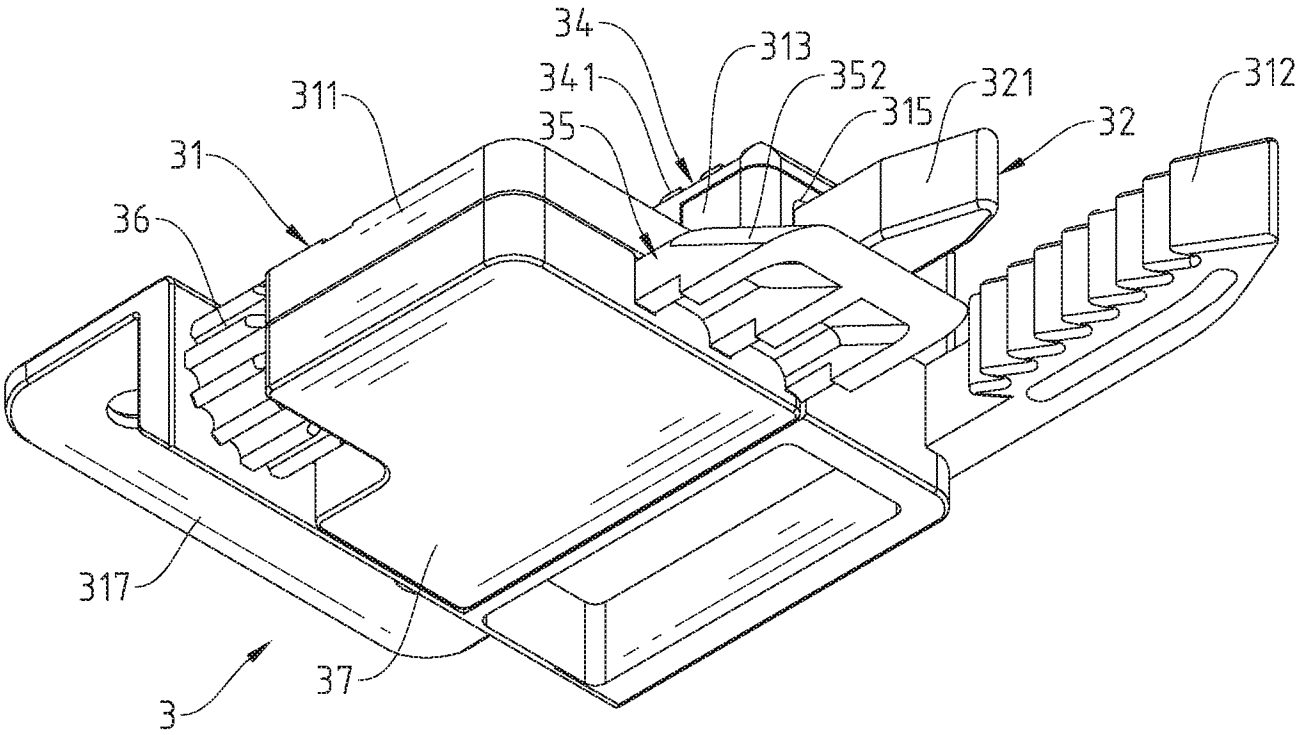
FIG. 3 corresponds to FIG. 2 when viewed from another angle.
Figure 5:
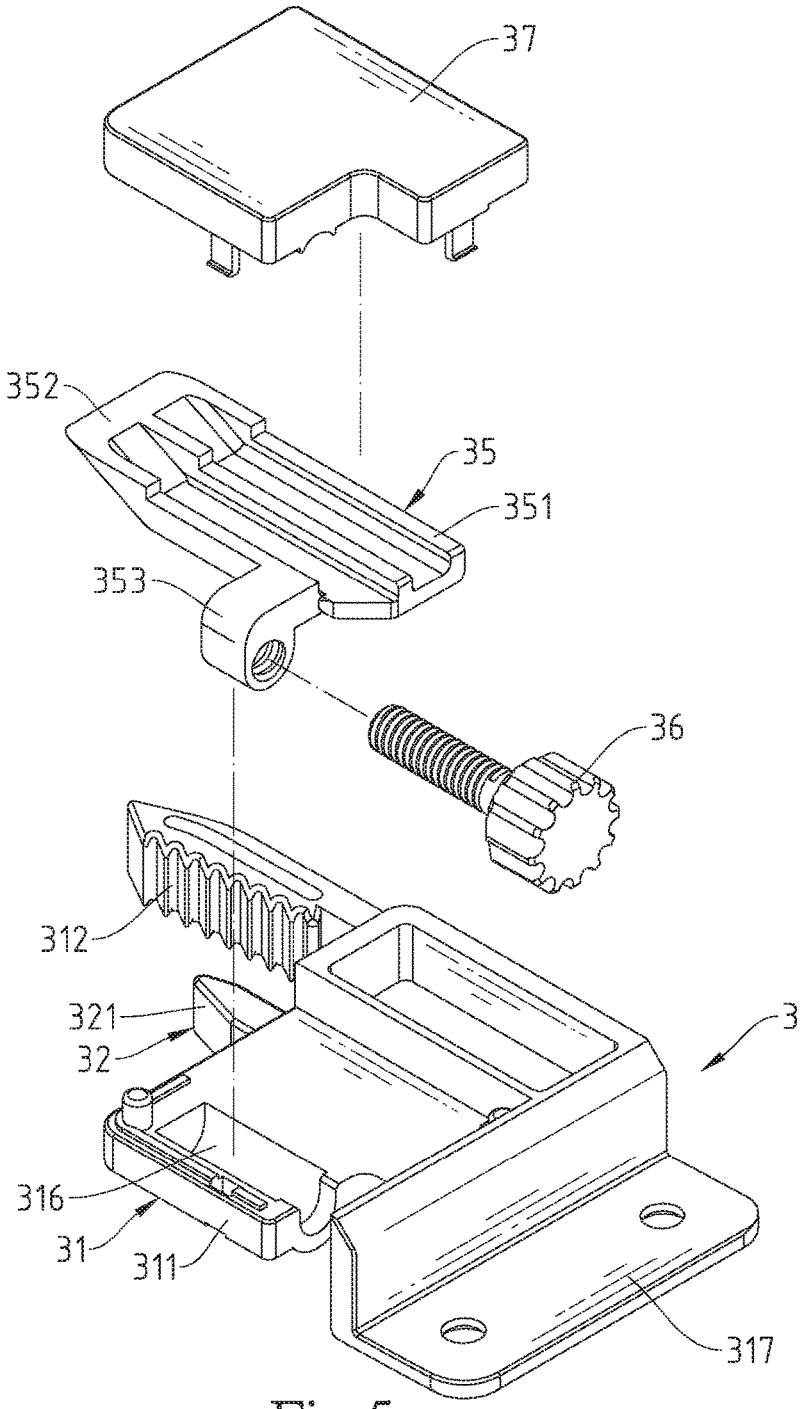
FIG. 5 is another exploded view of the mating connection device set of the quick detachable slide rail and drawer mounting structure in accordance with the present invention.
Figure 7:
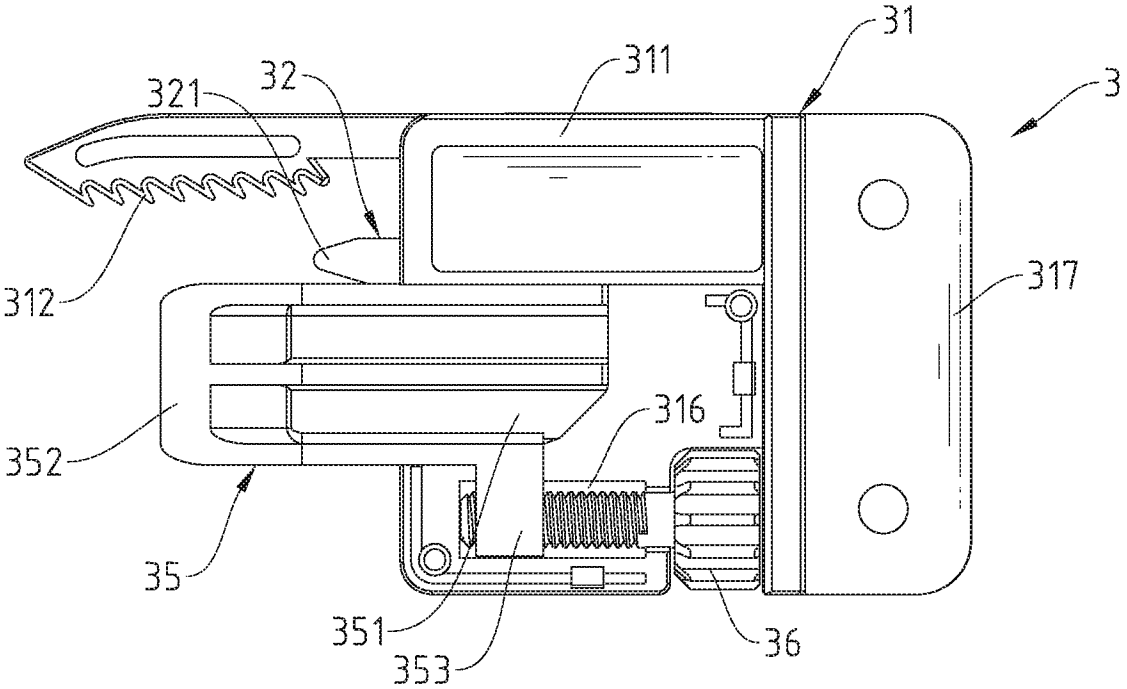
FIG. 7 is a schematic drawing of the present invention, illustrating the position of the shock damper of the mating connection device set adjusted.
Figure 8:
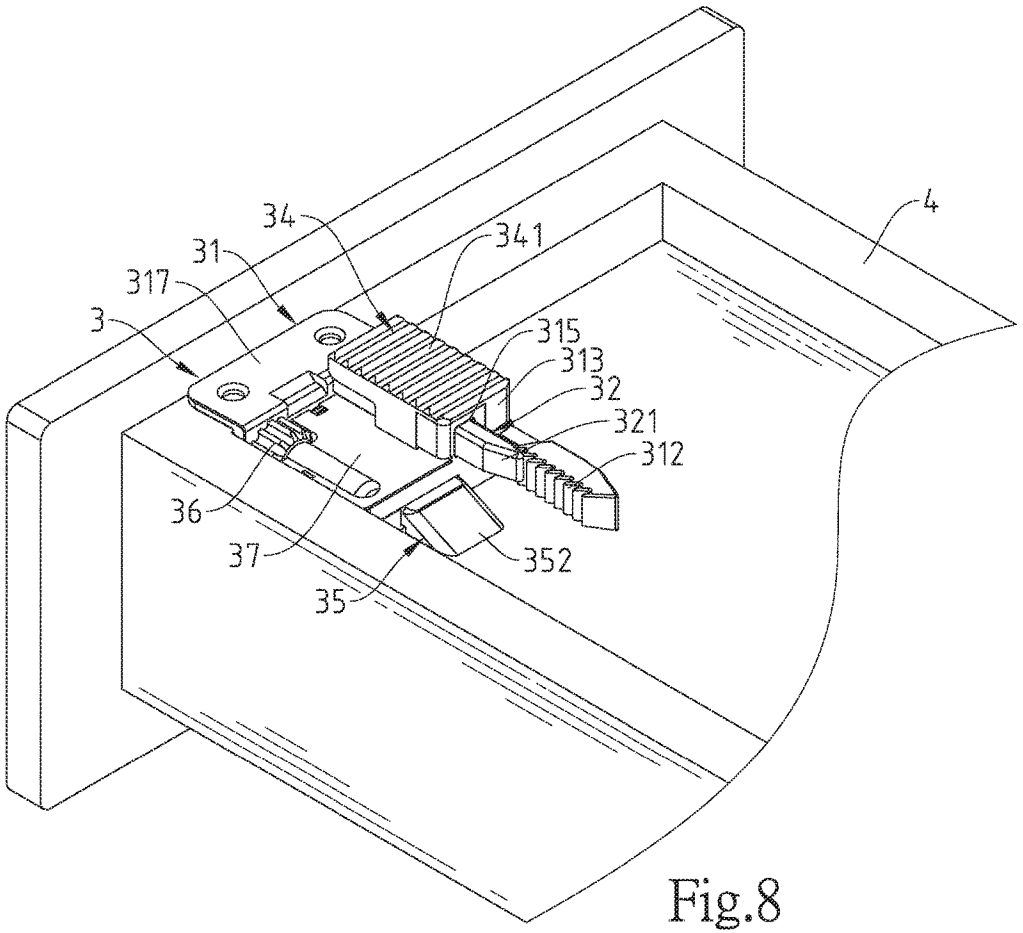
FIG. 8 is a schematic installed view of the present invention, illustrating the connection relationship between the mating connection device set and the drawer.
Figure 9:
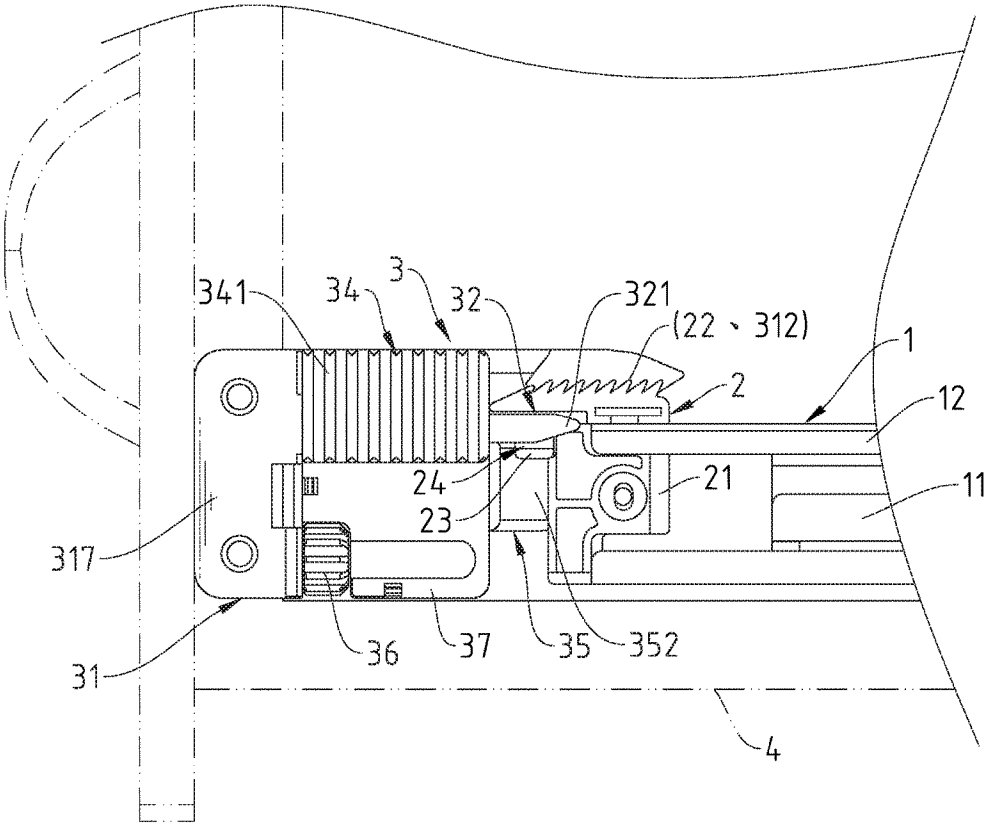
FIG. 9 is a schematic bottom view of the present invention, illustrating connection between the slide rail assembly and the drawer.
Figure 10:
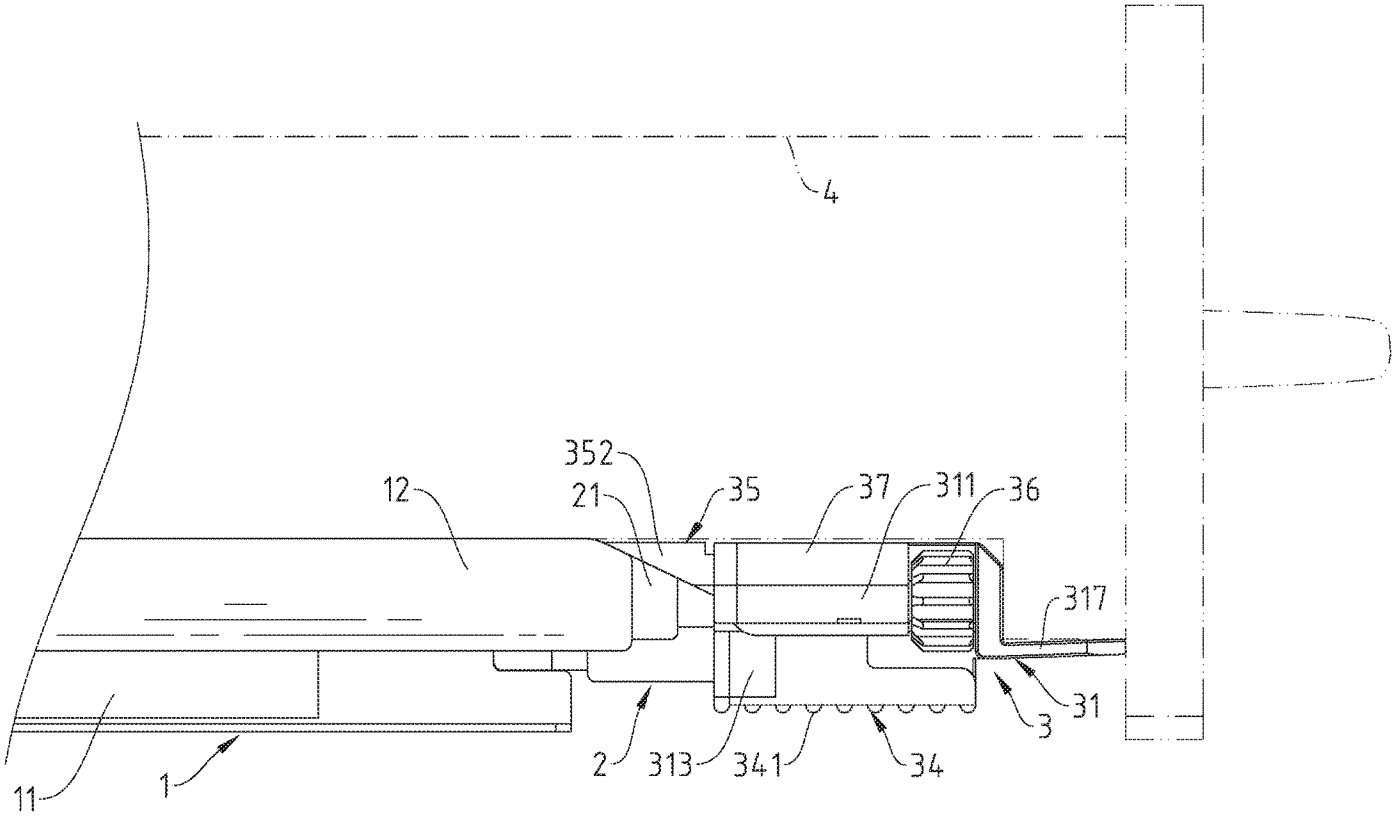
FIG. 10 is a schematic side view of the present invention, illustrating the connection relationship between the slide rail assembly and the drawer.

Referring to FIGS. 3, 5 and 7, the bottom panel 311 of the mating connection device set 3 further defines a guide groove 316. The shock damper 35 comprises a displacement portion 351, a beveled shock damping portion 352 located at a front end of the displacement portion 351, and a fixed nut 353 located at one lateral side thereof. The displacement portion 351 of the shock damper 35 is supported on a top surface of the bottom panel 311. The fixed nut 353 is positioned in the guide groove 316. The adjustment screw bolt 36 is threaded into the fixed nut 353. The top cover 37 is covered on the top surface of the bottom panel 311 to hold the shock damper 35 and the adjustment screw bolt 36 therein. Thus, the adjustment screw bolt 36 can be rotated to move the displacement portion 351 of the shock damper 35 along the surface of the bottom panel 311, thereby moving the shock damping portion 352 in or out of the bottom panel 311.

Referring to FIGS. 6-10, in application, the mounting plate 317 of the mating connection device set 3 is affixed to a bottom wall of the drawer 4, and then the drawer 4 is fastened to the outer slide rail 12, and then the connection member 2 and the mating connection device set 3 are moved toward each other to force the first toothed rack 22 of the connection member 2 into engagement with the second toothed rack 312 of the mating connection device set 3, securing the drawer 4 positively in place against longitudinal and sideway displacement. At this time, the abutment member 32 of the mating connection device set 3 is exposed to the outside of the bottom panel 311 and positioned in the insertion groove 24 of the connection member 2 to prohibit relative vertical displacement between the drawer 4 and the outer slide rail 12. When separating the slide rail assembly 1 and the drawer 4, operate the push member 34 to move the abutment member 32 into the inside of the accommodation chamber 314, and then lift the drawer 4 to separate the first toothed rack 22 from the second toothed rack 312. Further, after connection between the drawer 4 and the outer slide rail 12, the adjustment screw bolt 36 can be rotated to move the shock damping portion 352 of the shock damper 35 out of the bottom panel 311 into engagement in between the drawer 4 and the base 21 of the connection member 2, adjusting the elevation of the drawer 4 and eliminating the gap between the drawer 4 and the base 21 to reduce shocks.

What is claimed is:

1. A quick detachable slide rail and drawer mounting structure, comprising:

a slide rail assembly comprising an inner slide rail and an outer slide rail, said outer slide rail being attached onto said inner slide rail and slidable relative to said inner slide rail;

a drawer fastened to said outer slide rail of said slide rail assembly;

a connection member comprising a base and a first toothed rack disposed on one lateral side of said base, said base being affixed to a distal end of said outer slide rail of said slide rail assembly to hold said first toothed rack on one lateral side of said outer slide rail; and a mating connection device set comprising a holder block and an abutment member, said holder block comprising a bottom panel and a second toothed rack disposed on one side of said bottom panel, said abutment member being mounted on a bottom side of said bottom panel and movable in and out of said bottom panel, said holder block being mounted at a bottom wall of said drawer;

wherein when said drawer and said outer slide rail of said slide rail assembly are connected together, said first toothed rack of said connection member is engaged with said second toothed rack of said mating connection device set to prohibit said drawer from longitudinal and sideway displacement, and said abutment member of said mating connection device set is exposed to an outside of said bottom panel and disposed at a bottom side of said base of said connection member to prohibit relative vertical displacement between said drawer and said outer slide rail; and wherein said mating connection device set further comprises a receptacle located at said bottom side of said bottom panel and defining an accommodation chamber for accommodating said abutment member and a front opening for the passing of said abutment member, and a spring member mounted in said accommodation chamber and stopped between said abutment member and an inside wall of said receptacle in said accommodation chamber for allowing said abutment member to be moved in and out of said front opening of said receptacle.

2. The quick detachable slide rail and drawer mounting structure as claimed in claim 1, wherein:

said abutment member comprises an abutment end portion located at one end thereof and extending out of said front opening of said receptacle, an opposing mounting end portion located at an opposite end thereof and disposed in said accommodation chamber, and two locating grooves located on said mounting end portion at two opposite lateral sides; and said mating connection device set further comprises a push member supported on said receptacle outside said accommodation chamber, said push member comprising a pushing portion, and a retaining portion located at a bottom side of said pushing portion and inserted into said accommodation chamber and engaged with said locating grooves for allowing said push member to be forced by an external force to move said abutment member in and out of said accommodation chamber through said front opening.

3. The quick detachable slide rail and drawer mounting structure as claimed in claim 1, wherein said mating connection device set further comprises a mounting plate extended extending from one end of said bottom panel of said holder block and affixed to said bottom wall of said drawer.

4. The quick detachable slide rail and drawer mounting structure as claimed in claim 1, wherein said connection member further comprises a stop block extending from a bottom side of said base, and an insertion groove defined between said stop block and said first toothed rack; said abutment member of said mating connection device set is inserted into said insertion groove when said abutment member is extended out of said bottom panel.

5. A quick detachable slide rail and drawer mounting structure, comprising:

a slide rail assembly comprising an inner slide rail and an outer slide rail, said outer slide rail being attached onto said inner slide rail and slidable relative to said inner slide rail;

a drawer fastened to said outer slide rail of said slide rail assembly;

a connection member comprising a base and a first toothed rack disposed on one lateral side of said base, said base being affixed to a distal end of said outer slide rail of said slide rail assembly to hold said first toothed rack on one lateral side of said outer slide rail; and a mating connection device set comprising a holder block and an abutment member, said holder block comprising a bottom panel and a second toothed rack disposed on one side of said bottom panel, said abutment member being mounted on a bottom side of said bottom panel and movable in and out of said bottom panel, said holder block being mounted at a bottom wall of said drawer;

wherein when said drawer and said outer slide rail of said slide rail assembly are connected together, said first toothed rack of said connection member is engaged with said second toothed rack of said mating connection device set to prohibit said drawer from longitudinal and sideway displacement, and said abutment member of said mating connection device set is exposed to an outside of said bottom panel and disposed at a bottom side of said base of said connection member to prohibit relative vertical displacement between said drawer and said outer slide rail; and wherein said mating connection device set further comprises a guide groove located in said bottom panel, a shock damper mounted at said bottom panel and an adjustment screw bolt fastened to said shock damper, said shock damper comprising a displacement portion, a shock damping portion located at a front end of said displacement portion and a fixed nut located at one lateral side of said displacement portion, said displacement portion of said shock damper being mounted at said bottom panel, said fixed nut being positioned in said guide groove, said adjustment screw bolt being threaded into said fixed nut and rotatable to move said displacement portion of said shock damper along said bottom panel to further force said shock damping portion out of said bottom panel into engagement in between said drawer and said base of said connection member.

6. The quick detachable slide rail and drawer mounting structure as claimed in claim 5, wherein said mating connection device set further comprises a top cover covering said bottom panel to hold said shock damper and said adjustment screw bolt therein.

7. The quick detachable slide rail and drawer mounting structure as claimed in claim 5, wherein said mating connection device set further comprises a mounting plate extending from one end of said bottom panel of said holder block and affixed to said bottom wall of said drawer.

8. The quick detachable slide rail and drawer mounting structure as claimed in claim 5, wherein said connection member further comprises a stop block extending from a bottom side of said base, and an insertion groove defined between said stop block and said first toothed rack; said abutment member of said mating connection device set is inserted into said insertion groove when said abutment member is extended out of said bottom panel.

* * * * *